US008840493B2

(12) United States Patent
Nakamura et al.

(10) Patent No.: US 8,840,493 B2
(45) **Date of Patent: *Sep. 23, 2014**

(54) GOLF BALL

(75) Inventors: Hirotaka Nakamura, Kobe (JP); Keiji Ohama, Kobe (JP); Seiichiro Endo, Kobe (JP)

(73) Assignee: SRI Sports Limited, Kobe (JP)

( * ) Notice: Subject to any disclaimer, the term of this patent is extended or adjusted under 35 U.S.C. 154(b) by 347 days.

This patent is subject to a terminal disclaimer.

(21) Appl. No.: 12/880,667

(22) Filed: Sep. 13, 2010

(65) Prior Publication Data

US 2011/0092315 A1 Apr. 21, 2011

(30) Foreign Application Priority Data

Oct. 15, 2009 (JP) ..... 2009-237818

(51) Int. Cl.
*A63B 37/06* (2006.01)
*A63B 37/00* (2006.01)

(52) U.S. Cl.
CPC ..... *A63B 37/0092* (2013.01); *A63B 37/0045* (2013.01); *A63B 37/0022* (2013.01); *A63B 37/0043* (2013.01); *A63B 37/0076* (2013.01); *A63B 37/0031* (2013.01); *A63B 37/0033* (2013.01); *A63B 37/0063* (2013.01); *A63B 37/0062* (2013.01)
USPC ..... 473/376

(58) Field of Classification Search
USPC ..... 473/376, 373, 374
See application file for complete search history.

(56) References Cited

U.S. PATENT DOCUMENTS

| | | | | |
|---|---|---|---|---|
| 5,688,595 | A | 11/1997 | Yamagishi et al. | |
| 6,354,967 | B1 * | 3/2002 | Nakamura et al. | 473/378 |
| 8,206,245 | B2 * | 6/2012 | Kamino et al. | 473/376 |
| 2002/0034987 | A1 | 3/2002 | Yamagishi et al. | |
| 2002/0119840 | A1 | 8/2002 | Higuchi et al. | |
| 2003/0109333 | A1 | 6/2003 | Yamagishi et al. | |
| 2005/0075196 | A1 | 4/2005 | Shimizu et al. | |
| 2008/0146377 | A1 * | 6/2008 | Watanabe | 473/376 |
| 2009/0036236 | A1 * | 2/2009 | Nanba et al. | 473/376 |
| 2009/0124420 | A1 | 5/2009 | Kamino et al. | |
| 2009/0197701 | A1 | 8/2009 | Yamagishi et al. | |

FOREIGN PATENT DOCUMENTS

| | | | |
|---|---|---|---|
| JP | 8-336617 | A | 12/1996 |
| JP | 2002-191719 | A | 7/2002 |
| JP | 2004-180822 | A | 7/2004 |
| WO | 2008-149130 | A1 | 7/2008 |
| WO | 2009-112647 | A1 | 5/2009 |

* cited by examiner

*Primary Examiner* — Raeann Gorden
(74) *Attorney, Agent, or Firm* — Birch, Stewart, Kolasch & Birch, LLP

(57) ABSTRACT

Golf ball 2 has spherical core 4, surrounding layer 6 situated on the external side of the core 4, mid layer 8 situated on the external side of the surrounding layer 6, cover 10 situated on the external side of the mid layer 8, and paint layer 12 situated on the external side of the cover 10. The mid layer 8 has a thickness Tm of 0.1 mm or greater and 1.2 mm or less. The ratio (Tc/Tm) of the thickness Tc of the cover 10 to the thickness Tm of the mid layer 8 is no greater than 0.50. The cover 10 has a Shore D hardness Hc of no greater than 35. The Shore D hardness Hm of the mid layer 8 is greater than the Shore D hardness Hc of the cover 10. The base material of the surrounding layer 6 is an ionomer resin. The base material of the mid layer 8 is a polyurethane. The base material of the cover 10 is a polyurethane.

14 Claims, 1 Drawing Sheet

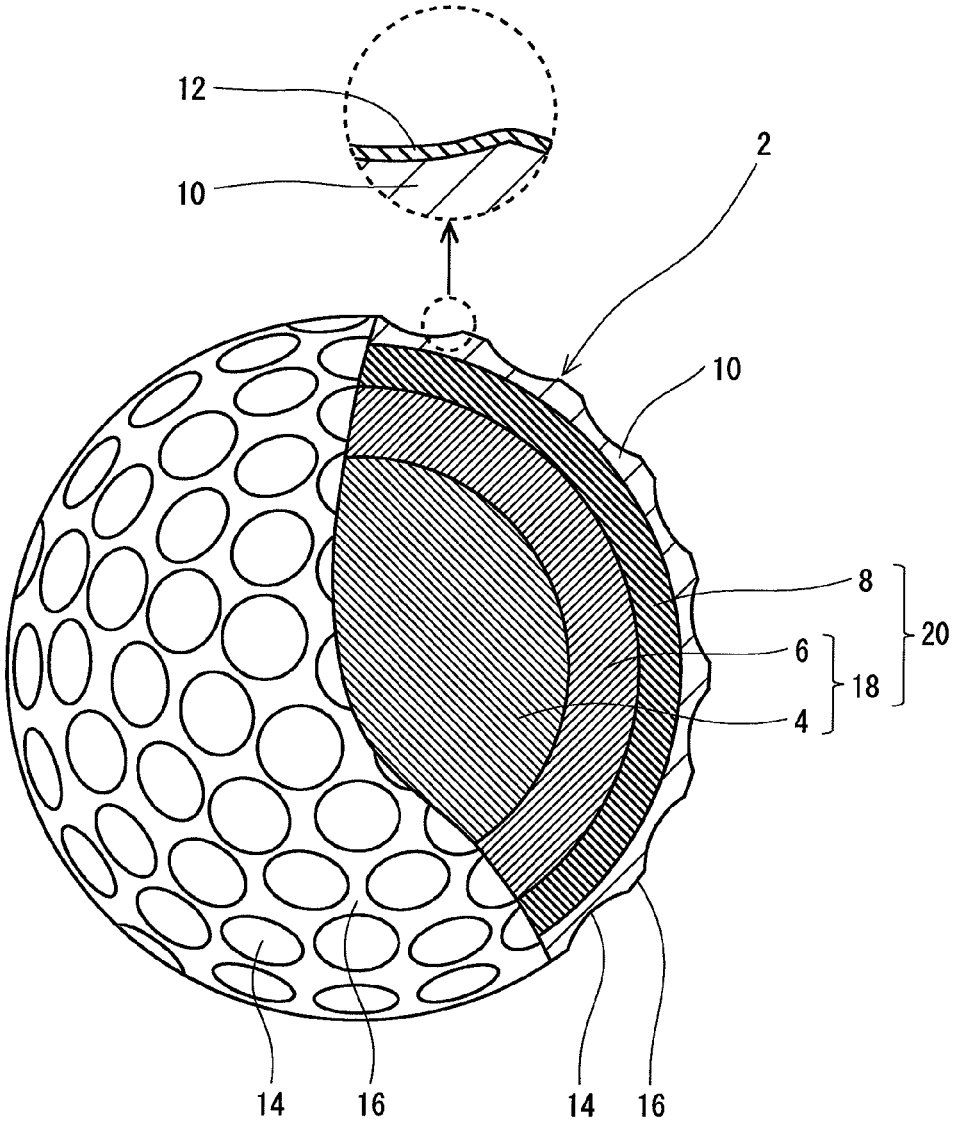
12
10
2
10
8
20
6
18
4
14
16
14
16

GOLF BALL

This application claims priority on Patent Application No. 2009-237818 filed in JAPAN on Oct. 15, 2009. The entire contents of this Japanese Patent Application are hereby incorporated by reference.

BACKGROUND OF THE INVENTION

1. Field of the Invention

The present invention relates to golf balls. More particularly, the present invention relates to multi-piece golf balls having a core, a surrounding layer, a mid layer and a cover.

2. Description of the Related Art

Top concern to golf players for golf balls is their flight performances. The golf players particularly place great importance on flight distance attained upon shots with a driver. Use of a golf ball which can attain a great flight distance upon shots with a driver enables the golf player to hit the second shot from a point near the green. The flight distance attained upon shots with a driver correlates with the spin rate. Golf balls accompanied by a small spin rate are excellent in flight performances. The flight performances further correlate with resilience performances of the golf ball.

The golf players place great importance also on spin performances of the golf balls. Great back spin rate results in small run. By using a golf ball accompanied by a great back spin rate, golf players can allow the golf ball to stop at a target point. Great side spin rate results in easily curved trajectory of the golf ball. Golf players can achieve an intentionally curved trajectory by using the golf ball accompanied by a great side spin rate. The golf balls that are excellent in spin performances are excellent in control performances. High-level golf players particularly place great importance on control performances upon shots with a short iron.

Iron clubs have several grooves on the face. These grooves suppress slipping of the golf ball on the face. Shots with suppressed slipping achieve a great spin rate. R&A rules for iron club are going to be changed on Jan. 1, 2010. According to new rules, shapes of the grooves are regulated. Spin is less likely to be permitted with iron clubs that conform to new rules. Golf balls which are sufficiently spun even when hit with an iron club that conforms to the new rules have been demanded.

When a golf ball placed on rough is hit, turfgrass is interposed between the golf ball and the face. This turfgrass promotes slipping of the golf ball on the face. A shot accompanied by excessive slipping results in reduced spin rate. Golf balls which can be accompanied by sufficient spin even when hit on rough have been demanded.

Golf balls having a cover produced using a polyurethane have been commercially available. A polyurethane is soft, in general. This golf ball is likely to be spun. This cover is responsible for control performances. On the other hand, when this golf ball is hit with a driver, the cover may lead to excessive spin. This cover interferes the flight performance.

In order to achieve well-balanced flight performances and control performances, a variety of proposals have been made. Japanese Unexamined Patent Application Publication No. H8-336617 discloses a golf ball having a core with a two-layer structure, and a cover with a two-layer structure. US 2002/119840 (Japanese Unexamined Patent Application Publication No. 2002-191719) discloses a golf ball having a core and a cover with a three-layer structure. US 2005/075196 (Japanese Unexamined Patent Application Publication No. 2004-180822) discloses a golf ball having a core, an inner mid layer, an external mid layer and a cover.

The golf ball disclosed in Japanese Unexamined Patent Application Publication No. H8-336617 has a soft inner cover, and a hard external cover. This golf ball is spun insufficiently upon shots with a short iron. In addition, this golf ball achieves insufficient flight distance upon shots with a driver.

The golf ball disclosed in US 2002/119840 has a hard external cover. This golf ball is spun insufficiently upon shots with a short iron.

The golf ball disclosed in US 2005/075196 has a hard cover. This golf ball is spun insufficiently upon shots with a short iron.

Requirements for golf balls by golf players have been increasingly escalated. An object of the present invention is to provide a golf ball that is excellent in the flight performance and the control performance.

SUMMARY OF THE INVENTION

The golf ball according to one aspect of the present invention has a core, a surrounding layer situated on the external side of the core, a mid layer situated on the external side of the surrounding layer, and a cover situated on the external side of the mid layer. The mid layer has a thickness Tm of 0.1 mm or greater and 1.2 mm or less. The ratio (Tc/Tm) of the thickness Tc of the cover to the thickness Tm of the mid layer is no greater than 0.50. The cover has a Shore D hardness Hc of no greater than 35. The Shore D hardness Hm of the mid layer is greater than the Shore D hardness Hc of the cover.

Spin rate is affected by:

(1) the extent of invasion of the cover into the groove of the club face; and (2) gripping property for the golf ball of the club face. Short irons have a great loft angle and deep grooves. On the other hand, drivers have a small loft angle and shallow grooves. There also exist drivers having no groove at the center of the face. Short irons result in a low head speed, whereas drivers result in a high head speed. The spin rate of golf balls upon hitting with a short iron greatly depends on the extent of invasion of the cover into the groove. The spin rate of the golf balls upon hitting with a driver greatly depends on the gripping property for the golf ball of the face. When the golf ball according to the present invention is hit with a short iron, the cover sufficiently invades into the grooves of the face since this golf ball has a soft cover. This invasion suppresses slipping of the golf ball on the face. By suppressing the slipping, a great spin rate is achieved. This golf ball achieves a great spin rate of when hit with an iron club that conforms to the new rules. A great spin rate of this golf ball is also achieved upon hitting with a short iron on the rough. Moreover, a great spin rate of this golf ball is also achieved upon hitting with a short iron in a wet state. This cover is thin, and the mid layer is harder than the cover. When this golf ball is hit with a driver, the mid layer affects a deformation behavior. This mid layer suppresses the spin upon hitting with a driver. Suppression of the spin leads to attainment of a great flight distance. This golf ball is excellent in the flight performances upon hitting with a driver, and is also excellent in the control performances upon hitting with a short iron.

Preferably, the base material of the mid layer is one or at least two selected from the group consisting of a polyurethane based elastomer, a polyester based elastomer, a polyamide based elastomer, a polyolefin based elastomer, a polystyrene based elastomer and an ionomer resin. A polyurethane is particularly preferred. Preferably, the mid layer has a Shore D hardness Hm of 30 or greater and 60 or less.

Preferably, the Shore D hardness Hs of the surrounding layer, the Shore D hardness Hm of the mid layer, and the Shore D hardness Hc of the cover satisfy the following mathematical expression (1):

$$Hs \geq Hm > Hc \quad (1).$$

Preferably, the hardness Hs, the hardness Hm and the hardness Hc satisfy the following mathematical expression (2):

$$Hs > Hm > Hc \quad (2).$$

Preferably, the difference (Hs−Hm) between the hardness Hs and the hardness Hm is 5 or greater and 40 or less. Preferably, the difference (Hm−Hc) between the hardness Hm and the hardnessHc is 3 or greater and 30 or less. Preferably, the difference (Hs−Hc) between the hardness Hs and the hardness Hc is 10 or greater and 60 or less.

Preferably, the surrounding layer has a Shore D hardness Hs of no less than 50. Preferably, the surrounding layer has a thickness Ts of 0.5 mm or greater and 2.4 mm or less. Preferably, the base material of the surrounding layer is an ionomer resin.

Preferably, the base material of the cover is one or at least two selected from the group consisting of a polyurethane based elastomer, a polyester based elastomer, a polyamide based elastomer, a polyolefin based elastomer, a polystyrene based elastomer and an ionomer resin. A polyurethane is particularly preferred. Preferably, the cover has a thickness Tc of no greater than 0.60 mm. Preferably, the ratio (Tc/Hc) of the thickness Tc (mm) of the cover to the hardness Hc of the cover is no greater than 0.018.

Preferably, the central point of the core has a JIS-C hardness H1 of 35 or greater and 80 or less. Preferably, the surface of the core has a JIS-C hardness H2 of 45 or greater and 100 or less. Preferably, the difference (H2−H1) between the JIS-C hardness H2 of the surface and the JIS-C hardness H1of the central point of the core is 5 or greater and 35 or less.

Preferably, the golf ball further has a paint layer situated on the external side of the cover.

BRIEF DESCRIPTION OF THE DRAWINGS

FIG. 1 shows a schematic cross-sectional view illustrating a golf ball according to one embodiment of the present invention.

DESCRIPTION OF THE PREFERRED EMBODIMENTS

Hereinafter, the present invention will be described in detail according to the preferred embodiments with appropriate references to the accompanying drawing.

Golf ball 2 shown in FIG. 1 has spherical core 4, surrounding layer 6 situated on the external side of the core 4, mid layer 8 situated on the external side of the surrounding layer 6, cover 10 situated on the external side of the mid layer 8, and paint layer 12 situated on the external side of the cover 10. A large number of dimples 14 are formed on the surface of the cover 10. Of the surface of the golf ball 2, a part other than the dimples 14 is land 16. This golf ball 2 has a mark layer between the cover 10 and the paint layer 12 (not shown in the FIGURE). It is not necessary that the golf ball 2 has a paint layer 12.

This golf ball 2 has a diameter of from 40 mm to 45 mm. From the standpoint of conformity to a rule defined by United States Golf Association (USGA), the diameter is preferably no less than 42.67 mm. In light of suppression of the air resistance, the diameter is preferably no greater than 44 mm, and more preferably no greater than 42.80 mm. The weight of this golf ball 2 is 40 g or greater and 50 g or less. In light of attainment of great inertia, the weight is preferably no less than 44 g, and more preferably no less than 45.00 g. From the standpoint of conformity to a rule defined by USGA, the weight is preferably no greater than 45.93 g.

The core 4 is obtained through crosslinking of a rubber composition. Illustrative examples of preferable base rubber include polybutadienes, polyisoprenes, styrene-butadiene copolymers, ethylene-propylene-diene copolymers and natural rubbers. In light of the resilience performance, polybutadienes are preferred. When other rubber is used in combination with polybutadiene, it is preferred that the polybutadiene is included as a principal component. Specifically, the percentage of the amount of polybutadiene relative to the total amount of the base rubber is preferably no less than 50% by weight, and more preferably no less than 80% by weight. The percentage of cis-1,4 bonds in the polyurethane is preferably no less than 40%, and more preferably no less than 80%.

For crosslinking of the core 4, a co-crosslinking agent is preferably used. Preferable examples of the co-crosslinking agent in light of the resilience performance include monovalent or bivalent metal salts of an α,β-unsaturated carboxylic acid having 2 to 8 carbon atoms. Specific examples of the preferable co-crosslinking agent include zinc acrylate, magnesium acrylate, zinc methacrylate and magnesium methacrylate. In light of the resilience performance, zinc acrylate and zinc methacrylate are particularly preferred.

In light of the resilience performance of the golf ball 2, the amount of the co-crosslinking agent is preferably no less than 10 parts by weight, and more preferably no less than 15 parts by weight relative to 100 parts by weight of the base rubber. In light of soft feel at impact, the amount of the eco-crosslinking agent is preferably no greater than 50 parts by weight, and more preferably no greater than 45 parts by weight relative to 100 parts by weight of the base rubber.

Preferably, the rubber composition for use in the core 4 includes an organic peroxide together with the co-crosslinking agent. The organic peroxide serves as a crosslinking initiator. The organic peroxide is responsible for the resilience performance of the golf ball 2. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide. In light of versatility, dicumyl peroxide is preferred.

In light of the resilience performance of the golf ball 2, the amount of the organic peroxide is preferably no less than 0.1 parts by weight, more preferably no less than 0.3 parts by weight, and particularly preferably no less than 0.5 parts by weight relative to 100 parts by weight of the base rubber. In light of soft feel at impact, the amount of the organic peroxide is preferably no greater than 3.0 parts by weight, more preferably no greater than 2.8 parts by weight, and particularly preferably no greater than 2.5 parts by weight relative to 100 parts by weight of the base rubber.

Preferably, the rubber composition of the core 4 contains an organic sulfur compound. Illustrative examples of preferable organic sulfur compound include mono-substituted forms such as diphenyl disulfide, bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide, and bis(4-cyanophenyl) disulfide; di-substituted forms such as bis(2,5-dichlorophenyl)disulfide, bis(3,5-dichlorophenyl)disulfide, bis(2,6-dichlorophenyl)disulfide, bis(2,5-dibromophenyl) disulfide, bis(3,5-dibromophenyl)disulfide, bis(2-chloro-5-bromophenyl)disulfide, and bis(2-cyano-5-bromophenyl)

disulfide; tri-substituted forms such as bis(2,4,6-trichlorophenyl)disulfide, and bis(2-cyano-4-chloro-6-bromophenyl)disulfide; tetra-substituted forms such as bis(2,3,5,6-tetrachlorophenyl)disulfide; and penta-substituted forms such as bis(2,3,4,5,6-pentachlorophenyl)disulfide, and bis(2,3,4,5,6-pentabromophenyl)disulfide.

The organic sulfur compound is responsible for the resilience performance. Particularly preferred organic sulfur compounds are diphenyl disulfide, and bis(pentabromophenyl) disulfide.

In light of the resilience performance of the golf ball 2, the amount of the organic sulfur compound is preferably no less than 0.1 parts by weight, and more preferably no less than 0.2 parts by weight relative to 100 parts by weight of the base rubber. In light of soft feel at impact, the amount of the organic sulfur compound is preferably no greater than 1.5 parts by weight, more preferably no greater than 1.0 parts by weight, and particularly preferably no greater than 0.8 parts by weight relative to 100 parts by weight of the base rubber.

In the core 4 may be blended a filler for the purpose of adjusting the specific gravity and the like. Illustrative examples of suitable filler include zinc oxide, barium sulfate, calcium carbonate and magnesium carbonate. Powders composed of a highly dense metal may be also blended as the filler. Specific examples of the highly dense metal include tungsten and molybdenum. The amount of the filler is determined ad libitum so that the intended specific gravity of the core 4 can be accomplished. Particularly preferable filler is zinc oxide. Zinc oxide serves not only to adjust the specific gravity but also as a crosslinking activator. Various kinds of additives such as sulfur, an anti-aging agent, a coloring agent, a plasticizer, a dispersant and the like may be blended in an adequate amount in the core 4 as needed. In the core 4 may be also blended crosslinked rubber powders or synthetic resin powders.

In light of the resilience performance, the core 4 has a central hardness H1 of no less than 35, more preferably no less than 40, and particularly preferably no less than 45. In light of suppression of the spin upon shots with a driver, the central hardness H1 is preferably no greater than 80, more preferably no greater than 75, and particularly preferably no greater than 70. The central hardness H1 is measured by pushing with a JIS-C type hardness scale a section of the hemisphere, which had been obtained by cutting the core 4, at a central point thereof. For the measurement, an automated rubber hardness scale ("P1", trade name, available from Koubunshi Keiki Co., Ltd.) which is equipped with this hardness scale is used.

In light of the resilience performance, the core 4 has a surface hardness H2 of preferably no less than 45, more preferably no less than 50, and particularly preferably no less than 55. In light of the feel at impact, the surface hardness H2 is preferably no greater than 100, more preferably no greater than 95, and particularly preferably no greater than 90. The surface hardness is measured by pushing the surface of the core 4 with a JIS-C type hardness scale. For the measurement, an automated rubber hardness scale ("P1", trade name, available from Koubunshi Keiki Co., Ltd.) which is equipped with this hardness scale is used.

In light of the feel at impact, the difference (H2−H1) between the surface hardness H2 and the central hardness H1 is preferably no less than 5, more preferably no less than 8, and particularly preferably no less than 12. In light of the resilience performance, the difference (H2−H1) is preferably no greater than 35, more preferably no greater than 32, and particularly preferably no greater than 30.

In light of the feel at impact, the amount of compressive deformation D1 of the core 4 is preferably no less than 2.3 mm, more preferably no less than 2.4 mm, and particularly preferably no less than 2.5 mm. In light of the resilience performance, the amount of compressive deformation D1 is preferably no greater than 6.0 mm, more preferably no greater than 5.5 mm, and particularly preferably no greater than 4.0 mm.

Upon measurement of the amount of compressive deformation, a spherical body (core 4, golf ball 2, etc.) is placed on a hard plate made of metal. A cylinder made of metal gradually descends toward this spherical body. The spherical body interposed between the bottom face of the cylinder and the hard plate is deformed. A migration distance of the cylinder, starting from the state in which an initial load of 98 N is applied to the spherical body up to the state in which a final load of 1,274 N is applied thereto is defined as the amount of compressive deformation.

In light of the resilience performance, the core 4 has a diameter of preferably no less than 35.0 mm, more preferably no less than 36 mm, and particularly preferably no less than 37 mm. Since the surrounding layer 6 and the mid layer 8 having a sufficient thickness can be molded, the diameter is preferably no greater than 42.0 mm, more preferably no greater than 41.6 mm, and particularly preferably no greater than 41.2 mm.

The core 4 has a weight of preferably 25 g or greater and 42 g or less. The crosslinking temperature of the core 4 is usually 140° C. or higher and 180° C. or lower. The crosslinking time of the core 4 is usually 10 min or longer and 60 min or shorter. The core 4 may be formed with two or more layers. The core 4 may have a rib on the surface thereof.

For the surrounding layer 6, a resin composition is suitably used. Illustrative examples of the base polymer of the resin composition include ionomer resins, polystyrene based elastomers, polyurethane based elastomers, polyester based elastomers, polyamide based elastomers and polyolefin based elastomers. In particular, ionomer resins are preferred. The ionomer resins are highly elastic. As described later, this golf ball 2 has thin mid layer 8 and thin cover 10. Upon hitting of this golf ball 2 with a driver, the surrounding layer 6 is greatly deformed resulting from the mid layer 8 and the cover 10 being thin. The surrounding layer 6 containing the ionomer resin is responsible for the resilience performance upon shots with a driver.

An ionomer resin and other resin may be used in combination. When these are used in combination, the ionomer resin is included as the principal component of the base polymer, in light of the resilience performance. The percentage of the amount of the ionomer resin relative to the total amount of the base polymer is preferably no less than 50% by weight, more preferably no less than 70% by weight, and particularly preferably no less than 85%.

Examples of preferred ionomer resin include binary copolymers formed with α-olefin and an α,β-unsaturated carboxylic acid having 3 to 8 carbon atoms. Preferable binary copolymer comprises 80% by weight or more and 90% by weight or less α-olefin, and 10% by weight or more and 20% by weight or less α,β-unsaturated carboxylic acid. This binary copolymer provides excellent resilience performance. Examples of other ionomer resin preferred include ternary copolymers formed with α-olefin, an α,β-unsaturated carboxylic acid having 3 to 8 carbon atoms, and an α,β-unsaturated carboxylate ester having 2 to 22 carbon atoms. Preferable ternary copolymer comprises 70% by weight or more and 85% by weight or less α-olefin, 5% by weight or more and 30% by weight or less α,β-unsaturated carboxylic acid, and 1% by weight or more and 25% by weight or less α,β-unsaturated carboxylate ester. This ternary copolymer provides excellent resilience performance. In the binary copolymer and ternary copolymer, preferable α-olefin is ethylene and propylene, and preferable α,β-unsaturated carboxylic acid is acrylic acid and methacrylic acid. Particularly preferred ionomer resin is a copolymer formed with ethylene, and acrylic acid or methacrylic acid.

In the binary copolymer and ternary copolymer, a part of the carboxyl groups may be neutralized with a metal ion. Illustrative examples of the metal ion for use in the neutralization include sodium ion, potassium ion, lithium ion, zinc ion, calcium ion, magnesium ion, aluminum ion and neodymium ion. The neutralization may be carried out with two or more kinds of the metal ions. Particularly suitable metal ion in light of the resilience performance and durability of the golf ball 2 is sodium ion, zinc ion, lithium ion and magnesium ion.

Specific examples of the ionomer resin include "Himilan® 1555", "Himilan® 1557", "Himilan® 1605", "Himilan® 1706", "Himilan® 1707", "Himilan® 1856", "Himilan® 1855", "Himilan® AM7311", "Himilan® AM7315", "Himilan® AM7317", "Himilan® AM7318", "Himilan® MK7320" and "Himilan® MK7329", trade names, available from Du Pont-MITSUI POLYCHEMICALS Co., Ltd.; "Surlyn® 6120", "Surlyn® 6320", "Surlyn® 6910", "Surlyn® 7930", "Surlyn® 7940", "Surlyn® 8140", "Surlyn® 8150", "Surlyn® 8940", "Surlyn® 8945", "Surlyn® 9120", "Surlyn® 9150", "Surlyn® 9910", "Surlyn® 9945", "Surlyn® AD8546", "HPF 1000" and "HPF 2000", trade names, available from Du Pont Kabushiki Kaisha; and "IOTEK 7010", "IOTEK 7030", "IOTEK 7510", "IOTEK 7520", "IOTEK 8000" and "IOTEK 8030", trade names, available from EXXON Mobil Chemical Corporation. Two or more kinds of the ionomer resins may be used in combination. An ionomer resin neutralized with a monovalent metal ion and an ionomer resin neutralized with a bivalent metal ion may be used in combination.

As described later, the surrounding layer 6 is hard. Such a hard surrounding layer 6 can be attained by using an ionomer resin having a high acid content. The acid content is preferably 10% by weight or greater and 30% by weight or less. Specific examples of the ionomer resin having a high acid content include "Himilan® 1605", "Himilan® 1706", "Himilan® 1707", "Himilan® AM7311", "Himilan® AM7317", "Himilan® AM7318", "Himilan® AM7329", "Surlyn® 6120", "Surlyn® 6910", "Surlyn® 7930", "Surlyn® 7940", "Surlyn® 8140", "Surlyn® 8150", "Surlyn® 8940", "Surlyn® 8945", "Surlyn® 9120", "Surlyn® 9150", "Surlyn® 9910", "Surlyn® 9945", "Surlyn® AD8546", "IOTEK8000" and "IOTEK8030" described above.

Preferable polymer which may be used in combination with the ionomer resin is a polystyrene based elastomer. In particular, a styrene block-containing thermoplastic elastomer is preferred. The styrene block-containing thermoplastic elastomer includes a polystyrene block as a hard segment, and a soft segment. Typical soft segment is a diene block. Illustrative examples of the compound for the diene block include butadiene, isoprene, 1,3-pentadiene and 2,3-dimethyl-1,3-butadiene. Butadiene and isoprene are preferred. Two or more compounds may be used in combination.

The styrene block-containing thermoplastic elastomer may include a styrene-butadiene-styrene block copolymer (SBS), a styrene-isoprene-styrene block copolymer (SIS), a styrene-isoprene-butadiene-styrene block copolymer (SIBS), a hydrogenated product of SBS, a hydrogenated product of SIS or a hydrogenated product of SIBS. Exemplary hydrogenated product of SBS includes a styrene-ethylene-butylene-styrene block copolymer (SEBS). Exemplary hydrogenated product of SIS includes a styrene-ethylene-propylene-styrene block copolymer (SEPS). Exemplary hydrogenated product of SIBS includes a styrene-ethylene-ethylene-propylene-styrene block copolymer (SEEPS).

In light of the resilience performance of the golf ball 2, the content of the styrene component in the styrene block-containing thermoplastic elastomer is preferably no less than 10% by weight, more preferably no less than 12% by weight, and particularly preferably no less than 15% by weight. In light of the feel at impact of the golf ball 2, the content is preferably no greater than 50% by weight, more preferably no greater than 47% by weight, and particularly preferably no greater than 45% by weight.

In the present invention, the styrene block-containing thermoplastic elastomer includes an alloy of olefin with one or at least two types selected from the group consisting of SBS, SIS, SIBS, SEBS, SEPS and SEEPS, and hydrogenated products thereof. The olefin component in this alloy is speculated to contribute to improvement of the compatibility with other base polymer. When this alloy is used, the resilience performance of the golf ball 2 is improved. Preferably, olefin having 2 to 10 carbon atoms may be used. Illustrative examples of suitable olefin include ethylene, propylene, butene and pentene. Ethylene and propylene are particularly preferred.

Specific examples of the polymer alloy include "Rabalon® T3221C", "Rabalon® T3339C", "Rabalon® SJ4400N", "Rabalon® SJ5400N", "Rabalon® SJ6400N", "Rabalon® SJ7400N", "Rabalon® SJ8400N", "Rabalon® SJ9400N" and "Rabalon® SR04", trade names, available from Mitsubishi Chemical Corporation. Other specific examples of the styrene block-containing thermoplastic elastomer include "Epofriend A1010", trade name, available from Daicel Chemical Industries; and "Septon HG-252", trade name, available from Kuraray Co., Ltd.

Into the resin composition of the surrounding layer 6 may be blended a filler for the purpose of adjusting specific gravity and the like. Illustrative examples of the filler which may be used include zinc oxide, barium sulfate, calcium carbonate and magnesium carbonate. Powders composed of a highly dense metal may be blended as the filler. Specific examples of the highly dense metal include tungsten and molybdenum. The amount of the filler is determined ad libitum so that an intended specific gravity of the surrounding layer 6 can be attained. Into the surrounding layer 6 may be also blended a coloring agent, crosslinked rubber powders or synthetic resin powders.

Preferable filler is zinc oxide. As described later, the surrounding layer 6 is hard. Such a hard surrounding layer 6 can be attained by using zinc oxide. In light of the hard property, the amount of zinc oxide relative to 100 parts by weight of the base resin is preferably no less than 2 parts by weight, and particularly preferably no less than 5 parts by weight. The amount of zinc oxide is preferably no greater than 20 parts by weight. Zinc oxide in the form of a needle crystal exhibiting a three dimensional shape is particularly preferred. The zinc oxide has a first needle-shape part, a second needle-shape part and a third needle-shape part. A plane including the axis of the first needle-shape part and the axis of the second needle-shape part does not include the axis of the third needle-shape part. Specific examples of the zinc oxide in the form of the needle crystal include trade names "Panatetra WZ-0501" and "Panatetra WZ-0511" available from Matsushita Electric Industries Co., Ltd.

This surrounding layer 6 is hard. The golf ball 2 having such a hard surrounding layer 6 is excellent in the resilience performance. Spherical body 18 composed of the hard surrounding layer 6 and the core 4 achieves hardness distribution having externally growing gradient. The spin is suppressed when the golf ball 2 having such a hardness distribution is hit with a driver. Due to a synergistic effect of the resilience performance and the suppression of the spin, this golf ball 2 achieves superior flight performance. The golf ball 2 having such a hardness distribution is also excellent in the feel at impact. In light of the flight performance and feel at impact, the surrounding layer 6 has a hardness Hs of preferably no less than 50, more preferably no less than 58, and particularly preferably no less than 62. In light of the feel at impact and durability, the hardness Hs is preferably no greater than 85, more preferably no greater than 80, and particularly preferably no greater than 75.

In the present invention, the hardness Hs of the surrounding layer 6 may be measured in accordance with a standard of "ASTM-D 2240-68". For the measurement, an automated rubber hardness scale which is equipped with a Shore D type hardness scale ("P1", trade name, available from Koubunshi Keiki Co., Ltd.) is used. For the measurement, a sheet which was formed by hot press is used having a thickness of about 2 mm and consisting of the same material as that of the surrounding layer 6. Prior to the measurement, the sheet is stored at a temperature of 23° C. for two weeks. When the measurement is carried out, three sheets are overlaid.

In light of the flight performance, the surrounding layer 6 has a thickness Ts of preferably no less than 0.5 mm, more preferably no less than 0.7 mm, and particularly preferably no less than 0.9 mm. In light of the feel at impact, the thickness Ts is preferably no greater than 2.4 mm, more preferably no greater than 2.1 mm, and particularly preferably no greater than 1.7 mm.

For molding the surrounding layer 6, a known procedure may be employed such as injection molding and compression molding. Injection molding is preferred in light of the productivity.

In light of the feel at impact, the amount of compressive deformation Ds of the spherical body 18 composed of the core 4 and the surrounding layer 6 is preferably no less than 2.0 mm, more preferably no less than 2.1 mm, and particularly preferably no less than 2.2 mm. In light of the resilience performance, the amount of compressive deformation Ds is preferably no greater than 3.8 mm, more preferably no greater than 3.7 mm, and particularly preferably no greater than 3.6 mm.

The mid layer 8 is constituted with a resin composition. Illustrative examples of the base polymer of this resin composition include polyurethane based elastomers, polyester based elastomers, polyamide based elastomers, polyolefin based elastomers, polystyrene based elastomers and ionomer resins. In particular, a polyurethane is preferred. A polyurethane is soft. When the golf ball 2 is hit with a short iron, the cover 10 invades into the groove. In this stage, the cover 10 is deformed. Soft mid layer 8 permits the cover 10 to be deformed. This mid layer 8 is responsible for the control performance of the golf ball 2.

In the mid layer 8, the polyurethane and other resin may be used in combination. When thus used in combination, the polyurethane is included as a principal component of the base polymer in light of the control performance. The proportion of the amount of the polyurethane relative to the total amount of the base polymer is preferably no less than 50% by weight, more preferably no less than 70% by weight, and particularly preferably no less than 85% by weight.

A thermoplastic polyurethane and a thermosetting polyurethane may be used in the mid layer 8. In light of the productivity, a thermoplastic polyurethane is preferred. The thermoplastic polyurethane includes a polyurethane component as a hard segment, and a polyester component or a polyether component as a soft segment. Illustrative examples of the curing agent for the polyurethane component include an alicyclic diisocyanate, an aromatic diisocyanate and an aliphatic diisocyanate.

Illustrative examples of the alicyclic diisocyanate include 4,4'-dicyclohexylmethane diisocyanate ($H_{12}MDI$), 1,3-bis (isocyanatomethyl)cyclohexane ($H_6XDI$), isophorone diisocyanate (IPDI) and trans-1,4-cyclohexane diisocyanate (CHDI). In light of versatility and processability, $H_{12}MDI$ is preferred.

Illustrative examples of the aromatic diisocyanate include 4,4'-diphenylmethane diisocyanate (MDI) and toluene diisocyanate (TDI). Illustrative examples of the aliphatic diisocyanate include hexamethylene diisocyanate (HDI).

Particularly, an alicyclic diisocyanate is preferred. Since the alicyclic diisocyanate does not have a double bond in the main chain, yellowing of the mid layer 8 is suppressed. Two or more kinds of the diisocyanate may be used in combination.

Specific examples of the thermoplastic polyurethane include "Elastollan® ET370", "Elastollan® ET870-11V", "Elastollan® 1154D", "Elastollan® 1175A10W", "Elastollan® C60A10WN", "Elastollan® C70A10WN", "Elastollan® RVP2002", "Elastollan® XNY80A", "Elastollan® XNY85A", "Elastollan® XNY90A", "Elastollan® XNY97A", "Elastollan® XNY585" and "Elastollan® XKP016N", trade names, available from BASF Japan Ltd; and "Rezamin P4585LS" and "Rezamin PS62490", trade names, available from Dainichiseika Color & Chemicals Mfg. Co., Ltd.

Also, the mid layer 8 may be molded from a composition containing a thermoplastic polyurethane and an isocyanate compound. During or following molding of the mid layer 8, the polyurethane is crosslinked by this isocyanate compound.

Into the mid layer 8 may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate amount as needed. For the purpose of adjusting the specific gravity, powders of a highly dense metal such as tungsten or molybdenum may be blended into the mid layer 8.

The Shore D hardness Hm of the mid layer 8 is greater than the Shore D hardness Hc of the cover. This mid layer 8 inhibits excessive gripping of the golf ball 2 by the face upon hitting with a driver. This mid layer 8 suppresses the spin upon hitting with a driver. This golf ball 2 is excellent in the flight performance upon hitting with a driver.

The mid layer 8 has a hardness Hm of preferably no less than 30. This mid layer 8 suppresses the spin upon hitting with a driver. In this respect, the hardness Hm is more preferably no less than 32, and particularly preferably no less than 38. In light of the control performance upon hitting with a short iron, the hardness Hm is preferably no greater than 60, more preferably no greater than 57, and particularly preferably no greater than 54. The hardness Hm of the mid layer 8 is measured by a similar method to that of the hardness Hs of the surrounding layer 6.

In light of the control performance, the mid layer 8 has a thickness Tm of preferably no less than 0.1 mm, more preferably no less than 0.2 mm, and particularly preferably no less than 0.3 mm. In light of the flight performance, the thickness Tm is preferably no greater than 1.2 mm, more preferably no greater than 1.0 mm, and particularly preferably no greater than 0.8 mm.

For forming the mid layer 8, a known procedure may be employed such as injection molding, compression molding and casting.

In light of the feel at impact, the amount of compressive deformation Dm of spherical body 20 composed of the core 4, the surrounding layer 6 and the mid layer 8 is preferably no less than 1.8 mm, more preferably no less than 2.0 mm, and particularly preferably no less than 2.2 mm. In light of the resilience performance, the amount of compressive deformation Dm is preferably no greater than 3.8 mm, more preferably no greater than 3.6 mm, and particularly preferably no greater than 3.4 mm.

The cover 10 is constituted with a resin composition. Illustrative examples of the base polymer of this resin composition include polyurethane based elastomers, polyester based elastomers, polyamide based elastomers, polyolefin based elastomers, polystyrene based elastomers and ionomer resins. In particular, a polyurethane is preferred. A polyurethane is soft. Upon hitting with a short iron, this cover 10 sufficiently invades into the groove of the face. This invasion inhibits slipping of the golf ball 2 on the face. This cover 10 is responsible for the control performance of the golf ball 2.

In the cover 10, the polyurethane and other resin may be used in combination. When thus used in combination, the polyurethane is included as a principal component of the base polymer in light of the control performance. The proportion of the amount of the polyurethane relative to the total amount of the base polymer is preferably no less than 50% by weight, more preferably no less than 70% by weight, and particularly preferably no less than 85% by weight.

A thermoplastic polyurethane and a thermosetting polyurethane may be used in the cover 10. In light of the productivity, a thermoplastic polyurethane is preferred. The thermoplastic polyurethane exemplified in connection with the mid layer 8 may be also used in the cover 10. In light of the scuff resistance of the cover 10, a thermoplastic polyurethane in which $H_{12}$MDI is used as a curing agent of the polyurethane component is preferred. The cover 10 may be molded from a composition containing a thermoplastic polyurethane and an isocyanate compound. During or following molding of the cover 10, the polyurethane is crosslinked by this isocyanate compound.

As other polymer suited for the cover 10, a styrene block-containing thermoplastic elastomer may be included. The styrene block-containing thermoplastic elastomer described above in connection with the surrounding layer 6 may be used in the cover 10.

Into the cover 10 may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate amount as needed.

The Shore D hardness Hc of the cover is no greater than 35. When the golf ball 2 is hit with a short iron, this cover 10 sufficiently invades into the groove. A great spin rate can be achieved due to this cover 10. In light of the spin rate, the hardness Hc is more preferably no greater than 32, and particularly preferably no greater than 26. In light of the strength of the cover 10, the hardness Hc is preferably no less than 3, and particularly preferably no less than 5. The hardness Hc of the cover 10 is measured by a similar method to that of the hardness Hs of the surrounding layer 6.

The cover 10 has a thickness Tc of preferably no greater than 0.60 mm. The cover 10 having a thickness Tc of no greater than 0.60 mm inhibits excessive gripping of the golf ball 2 upon hitting with a driver. This cover 10 does not deteriorate the flight performance that may be achieved upon hitting with a driver. In light of the flight performance, the thickness Tc is preferably no greater than 0.50 mm, more preferably no greater than 0.40 mm, still more preferably no greater than 0.30 mm, even more preferably no greater than 0.20 mm, and particularly preferably no greater than 0.10 mm. In light of the control performance upon hitting with a short iron, the thickness Tc is preferably no less than 0.01 mm, more preferably no less than 0.03 mm, and particularly preferably no less than 0.05 mm.

The ratio (Tc/Hc) of the thickness Tc (mm) of the cover 10 to the hardness Hc of the cover 10 is preferably no greater than 0.018. The cover 10 having a small ratio (Tc/Hc) does not lead to excessive spin upon hitting with a driver. In this respect, the ratio (Tc/Hc) is more preferably no greater than 0.016, and particularly preferably no greater than 0.012. In light of the control performance upon hitting with a short iron, the ratio (Tc/Hc) is preferably no less than 0.001.

For forming the cover 10, a known procedure may be employed such as injection molding, compression molding and casting. Dimples 14 are formed by way of large number of pimples formed on the cavity face of the mold when the cover 10 is molded. Alternatively, the cover 10 may be formed by applying a solution or dispersion liquid of the resin composition on the surface of the mid layer 8.

The paint layer 12 is constituted with a resin composition. The paint layer 12 protects the cover 10. The paint layer 12 is responsible for the appearance of the golf ball 2. Preferable base resin of this resin composition is a two-component cured polyurethane. The two-component cured polyurethane is obtained by a reaction of a base material containing a polyol with a curing agent containing a polyisocyanate or a derivative thereof. The paint layer 12 including the two-component cured polyurethane is soft.

As the polyol for the base material, a polyol having a low molecular weight and a polyol having a high molecular weight may be used. Examples of the polyol having a low molecular weight include diols and triols. Specific examples of the diol include ethylene glycol, diethylene glycol, triethylene glycol, 1,3-butanediol, 1,4-butanediol, neopentyl glycol and 1,6-hexanediol. Specific examples of the triol include trimethylolpropane and hexanetriol. Examples of the polyol having a high molecular weight include polyether polyols such as polyoxyethylene glycol (PEG), polyoxypropylene glycol (PPG) and polyoxytetramethylene glycol (PTMG); condensed polyester polyols such as polyethylene adipate (PEA), polybutylene adipate (PBA) and polyhexamethylene adipate (PH2A); lactone based polyester polyols such as poly-ϵ-caprolactone (PCL); polycarbonate polyols such as polyhexamethylene carbonate; and acrylic polyols. Polyols having a weight average molecular weight of 50 or greater and 2,000 or less, and particularly 100 or greater and 1,000 or less are preferred. Two or more kinds of the polyols may be used in combination.

An urethane polyol may be used for the base material. The urethane polyol has a urethane bond, and at least two or more hydroxyl groups. Preferably, the urethane polyol has hydroxyl groups at its end. The urethane polyol may be obtained by allowing a polyol and a polyisocyanate to react at a ratio by which an excess molar ratio of the hydroxyl groups of the polyol to the isocyanate groups of the polyisocyanate is provided. By using the urethane polyol as the base material, the reaction of the base material with the curing agent can be completed within a short period of time. The base material may contain the urethane polyol, and a polyol not having any urethane bond.

Specific examples of the polyisocyanate used for producing the urethane polyol include aromatic polyisocyanates such as 2,4-toluene diisocyanate, 2,6-toluene diisocyanate, mixtures of 2,4-toluene diisocyanate and 2,6-toluene diisocyanate (TDI), 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylene diisocyanate (TMXDI) and paraphenylene diisocyanate (PPDI); alicyclic polyisocyanates such as 4,4'-dicyclohexylmethane diisocyanate ($H_{12}MDI$), hydrogenated xylylene diisocyanate ($H_6XDI$), hexamethylene diisocyanate (HDI) and isophorone diisocyanate (IPDI); and aliphatic polyisocyanates. Two or more polyisocyanates may be used in combination.

As described above, the curing agent contains a polyisocyanate or a derivative thereof. The aforementioned polyisocyanate as a raw material of the urethane polyol may be used in the curing agent.

The paint layer 12 is obtained by coating a liquid, which had been prepared by dissolving or dispersing the base material and the curing agent in a solvent, on the surface of the cover 10. The coating may be carried out by electrostatic coating, spray coating or the like. The solvent is volatilized after the coating to permit a reaction of the base material with the curing agent, thereby forming the paint layer 12. The paint layer 12 has a thickness of preferably 5 μm or greater and 40 μm or less. The golf ball 2 may have two or more paint layers. The golf ball 2 may have a colored paint layer, and a clear paint layer.

In light of the feel at impact, the amount of compressive deformation Db of the golf ball 2 is preferably no less than 1.8 mm, more preferably no less than 1.9 mm, and particularly preferably no less than 2.0 mm. In light of the resilience performance, the amount of compressive deformation Db is preferably no greater than 3.8 mm, more preferably no greater than 3.7 mm, and particularly preferably no greater than 3.6 mm.

The golf ball 2 may have a reinforcing layer between the surrounding layer 6 and the mid layer 8. The reinforcing layer firmly adheres to the surrounding layer 6, and firmly adheres also to the mid layer 8. Due to the reinforcing layer, detachment of the mid layer 8 from the surrounding layer 6 can be suppressed. As described above, this golf ball 2 has thin mid layer 8 and thin cover 10. When this golf ball 2 is hit with an edge of a clubface, a wrinkle is liable to be generated. The reinforcing layer suppresses generation of such a wrinkle.

For the base polymer of the reinforcing layer, a two-component cured thermosetting resin may be suitably used. Specific examples of the two-component cured thermosetting resin include epoxy resins, urethane resins, acrylic resins, polyester based resins and cellulose based resins. In light of the strength and durability of the reinforcing layer, two-component cured epoxy resins and two-component cured urethane resins are preferred.

The reinforcing layer may include additives such as a coloring agent (typically, titanium dioxide), a phosphate based stabilizer, an antioxidant, a light stabilizer, a fluorescent brightening agent, an ultraviolet absorbent, a blocking preventive agent and the like. The additive may be added either to the base material or to the curing agent.

The reinforcing layer is obtained by coating a liquid, which had been prepared by dissolving or dispersing a base material and a curing agent in a solvent, on the surface of the surrounding layer 6. In light of the workability, coating with a spray gun is preferred. The solvent is volatilized after the coating to permit a reaction of the base material with the curing agent, thereby forming the reinforcing layer.

The ratio (Tc/Tm) of the thickness Tc of the cover to the thickness Tm of the mid layer is no greater than 0.50. In other words, the thickness Tc of the cover 10 is sufficiently small as compared with the thickness Tm of the mid layer 8. When this golf ball 2 is hit with a driver, the spin is suppressed. This golf ball 2 is excellent in the flight performance. In light of the flight performance, the ratio (Tc/Tm) is more preferably no greater than 0.42, and particularly preferably no greater than 0.38. In light of the control performance upon hitting with a short iron, the ratio (Tc/Tm) is preferably no less than 0.05, and particularly preferably no less than 0.08.

In this golf ball 2, the hardness Hs of the surrounding layer 6, the hardness Hm of the mid layer 8 and the hardness He of the cover 10 satisfy the following mathematical expression (1):

$$Hs \geq Hm > Hc \quad (1).$$

In this golf ball 2, the hardness gradually changes from the cover 10 to the surrounding layer 6. The gradual change of the hardness does not deteriorate the feel at impact of the golf ball 2.

Preferably, the hardness Hs of the surrounding layer 6, the hardness Hm of the mid layer 8 and the hardness He of the cover 10 satisfy the following mathematical expression (2):

$$Hs > Hm > Hc \quad (2).$$

In this golf ball 2, the surrounding layer 6 having a great hardness Hs is employed in light of the resilience performance. In this golf ball 2, the cover 10 having a small hardness Hc is employed in light of the control performance. By providing the mid layer 8 having a hardness Hm that is smaller than the hardness Hs and greater than the hardness He between the surrounding layer 6 and the cover 10, the hardness from the cover 10 via the mid layer 8 to the surrounding layer 6 gradually increases. This change of the hardness achieves soft feel at impact of the golf ball 2. The golf ball 2 that follows the definition according to the mathematical expression (2) is excellent in all terms of the feel at impact, the flight performance upon shots with a driver, the control performance upon shots with a short iron.

In light of the feel at impact, flight performance and control performance, the difference (Hs−Hm) between the hardness Hs and the hardness Hm is preferably 5 or greater and 40 or less, more preferably 10 or greater and 35 or less, and particularly preferably 10 or greater and 29 or less.

In light of the feel at impact, flight performance and control performance, the difference (Hm−Hc) between the hardness Hm and the hardness Hc is preferably 3 or greater and 30 or less, more preferably 5 or greater and 25 or less, and particularly preferably 9 or greater and 21 or less.

In light of the feel at impact, flight performance and control performance, the difference (Hs−Hc) between the hardness Hs and the hardness Hc is preferably 10 or greater and 60 or less, more preferably 15 or greater and 50 or less, and particularly preferably 19 or greater and 41 or less.

EXAMPLES

Example 1

A rubber composition was obtained by kneading 100 parts by weight of a high-cis polybutadiene ("BR-730", trade name, available from JSR Corporation), 34 parts by weight of zinc diacrylate, 5 parts by weight of zinc oxide, an adequate amount of barium sulfate, 0.5 parts by weight of diphenyl disulfide and 0.8 parts by weight of dicumyl peroxide (NOF Corporation). This rubber composition was placed into a mold having upper and lower mold half each having a hemispherical cavity, and heated at 170° C. for 18 minutes to obtain a core having a diameter of 39.60 mm. The amount of barium sulfate was adjusted such that a golf ball having a weight of 45.6 g was obtained.

A resin composition (I) was obtained by kneading 50 parts by weight of an ionomer resin ("Himilan® 1605", supra), 50 parts by weight of other ionomer resin ("Himilan® AM7329", supra), 10 parts by weight of zinc oxide ("Panatetra WZ-0501", supra) and 4 parts by weight of titanium dioxide in a biaxial kneading extruder. This resin composition (I) was rendered to cover around the core by injection molding to form a surrounding layer. This surrounding layer had a thickness of 1.00 mm.

A paint composition containing a two-component cured epoxy resin as a base polymer ("POLIN 750LE", trade name, available from Shinto Paint Co., Ltd.) was prepared. The base material liquid of this paint composition consists of 30 parts by weight of a bisphenol A type solid epoxy resin and 70 parts by weight of a solvent. The curing agent of this paint composition liquid consists of 40 parts by weight of denatured polyamide amine, 55 parts by weight of a solvent and 5 parts by weight of titanium dioxide. The weight ratio of the base material liquid and the curing agent liquid was 1/1. This paint composition was coated on the surface of the surrounding layer with a spray gun, and kept in an atmosphere of 23° C. for 6 hrs to give a reinforcing layer. This reinforcing layer had a thickness of 10 μm.

A resin composition (C) was obtained by kneading 100 parts by weight of a thermoplastic polyurethane elastomer (Elastollan® XNY90A, supra) and 4 parts by weight of titanium dioxide in a biaxial extruder. Half shells were obtained from this resin composition (C) with compression molding. A spherical body composed of the core, the surrounding layer and the reinforcing layer was covered by two pieces of the half shell. The half shells and the spherical body were placed into a mold having upper and lower mold half each having a hemispherical cavity to obtain a mid layer with compression molding. The mid layer had a thickness of 0.40 mm.

A resin composition (D) was obtained by kneading 100 parts by weight of a thermoplastic polyurethane elastomer (Elastollan® XNY85A, supra) and 4 parts by weight of titanium dioxide in a biaxial extruder. Half shells were obtained from this resin composition (D) with compression molding. A spherical body composed of the core, the surrounding layer, the reinforcing layer and the mid layer was covered by two pieces of the half shell. The half shells and the spherical body were placed into a final mold having upper and lower mold half each having a hemispherical cavity provided with a large number of pimples on the cavity face thereof to obtain a cover with compression molding. The cover had a thickness of 0.15 mm. A large number of dimples having a shape inverted from the shape of the pimple were formed on the cover. A clear paint including a two-component cured polyurethane as a base material was applied on this cover to give a golf ball of Example 1 having a diameter of 42.7 mm and a weight of about 45.6 g.

Examples 2 to 13 and Comparative Examples 1 to 5

Golf balls of Examples 2 to 13, and Comparative Examples 1 to 5 were obtained in a similar manner to Example 1 except that specifications of the core, the surrounding layer, the mid layer and the cover were as listed in Tables 2 to 5 below. Details of the resin compositions of the surrounding layer, the mid layer and the cover are presented in Table 1 below. The golf ball according to Comparative Example 1 does not have a mid layer.

[Shot with Driver]

A driver with a titanium head (SRI Sports Limited, trade name "SRIXON W505", shaft hardness: X, loft angle: 8.5°) was attached to a swing machine available from Golf Laboratory Co. Then the golf ball was hit under a condition to give the head speed of 50 m/sec, and the distance from the launching point to the point where the ball stopped was measured. Furthermore, the back spin rate immediately after the hitting was also measured. Mean values of the data obtained by measuring 12 times are shown in Tables 2 to 5 below.

[Shot with Sand Wedge Not Conforming to New Rules]

A sand wedge not conformed to new rules (SRI Sports Limited, trade name "SRIXON WG-705(58°)") was attached to a swing machine available from True Temper Co. Then the golf ball was hit under a condition to give the head speed of 21 m/sec, and the back spin rate was measured. Mean values of the data obtained by measuring 12 times are shown in Tables 2 to 5 below.

[Shot with Sand Wedge Conforming to New Rules]

A sand wedge conformed to new rules (SRI Sports Limited, trade name "SRIXON 1505 SW (57°)") was attached to a swing machine available from True Temper Co. Then the golf ball was hit under a condition to give the head speed of 21 m/sec, and the back spin rate was measured. Mean values of the data obtained by measuring 12 times are shown in Tables 2 to 5 below.

[Shot under Wet State]

A sand wedge conformed to new rules ("SRIXON I505 SW) (57°)", supra) was attached to a swing machine available from True Temper Co. Then water was applied on the face and the golf ball was hit under a condition to give the head speed of 21 m/sec, and then the back spin rate was measured. Mean values of the data obtained by measuring 12 times are shown in Tables 2 to 5 below.

TABLE 1

Compositions of surrounding layer, mid layer and cover (parts by weight)

| | A | B | C | D | E | F | G | H | I | J |
|---|---|---|---|---|---|---|---|---|---|---|
| Elastollan ® 1154D | 100 | — | — | — | — | — | — | — | — | — |
| Elastollan ® XNY97A | — | 100 | — | — | — | — | — | — | — | — |
| Elastollan ® XNY90A | — | — | 100 | — | — | — | — | — | — | — |
| Elastollan ® XNY85A | — | — | — | 100 | — | — | — | — | — | — |
| Elastollan ® XNY80A | — | — | — | — | 100 | — | — | — | — | — |
| Elastollan ® 1175A10W | — | — | — | — | — | 100 | — | — | — | — |
| Elastollan ® C60A10WN | — | — | — | — | — | — | 100 | — | — | — |
| Rabalon ® T3221C | — | — | — | — | — | — | — | 100 | — | 8 |
| Himilan ® 1605 | — | — | — | — | — | — | — | — | 50 | — |
| Himilan ® AM7329 | — | — | — | — | — | — | — | — | 50 | — |
| Himilan ® 1555 | — | — | — | — | — | — | — | — | — | 46 |
| Himilan ® 1557 | — | — | — | — | — | — | — | — | — | 46 |
| Panatetra WZ-0501 | — | — | — | — | — | — | — | — | — | 2 |
| Panatetra WZ-0511 | — | — | — | — | — | — | — | — | 10 | — |
| Titanium dioxide | 4 | 4 | 4 | 4 | 4 | 4 | 4 | 4 | 4 | 4 |
| Hardness | 54 | 47 | 38 | 32 | 26 | 22 | 16 | 5 | 67 | 57 |

TABLE 2

| Evaluation results | | | | | | |
|---|---|---|---|---|---|---|
| | | Example 1 | Example 2 | Example 3 | Example 4 | Example 5 |
| Core | Diameter (mm) | 39.60 | 39.70 | 39.70 | 39.70 | 39.80 |
| | Amount of compressive deformation D1 (mm) | 3.2 | 3.2 | 3.2 | 3.2 | 3.2 |
| | Surface hardness H2 (JIS-C) | 82 | 82 | 82 | 82 | 82 |
| Sur-rounding layer | Composition | I | I | I | I | I |
| | Thickness Ts (mm) | 1.00 | 1.00 | 1.00 | 1.00 | 1.00 |
| | Hardness HS (Shore D) | 67 | 67 | 67 | 67 | 67 |
| Mid layer | Composition | C | C | C | C | C |
| | Thickness Tm (mm) | 0.40 | 0.40 | 0.40 | 0.40 | 0.40 |
| | Hardness Hm (Shore D) | 38 | 38 | 38 | 38 | 38 |
| Cover | Composition | D | D | E | F | E |
| | Thickness Tc (mm) | 0.15 | 0.10 | 0.10 | 0.10 | 0.05 |
| | Hardness Hc (Shore D) | 32 | 32 | 26 | 22 | 26 |
| | Tc/Tm | 0.38 | 0.25 | 0.25 | 0.25 | 0.13 |
| | Tc/Hc | 0.005 | 0.003 | 0.004 | 0.005 | 0.002 |
| | Hm − Hc | 6 | 6 | 12 | 16 | 12 |
| W#1 | Spin (rpm) | 2350 | 2300 | 2300 | 2350 | 2300 |
| | Flight distance (m) | 276.0 | 276.5 | 276.5 | 276.0 | 276.5 |
| SW *1 | Spin (rpm) | 7200 | 7150 | 7150 | 7150 | 7100 |
| SW *2 | Spin (rpm) | 7050 | 7000 | 7050 | 7050 | 7000 |
| | Spin (wet) (rpm) | 6050 | 6000 | 6100 | 6100 | 6050 |

*1 Sand wedge not conforming to new rule

*2 Sand wedge conforming to new rule

TABLE 3

| Evaluation Results | | | | | |
|---|---|---|---|---|---|
| | | Example 6 | Example 7 | Example 8 | Example 9 |
| Core | Diameter (mm) | 39.74 | 39.84 | 39.50 | 39.00 |
| | Amount of compressive deformation D1 (mm) | 3.3 | 3.3 | 3.2 | 3.1 |
| | Surface hardness H2 (JIS-C) | 82 | 82 | 82 | 81 |
| Surround-ing layer | Composition | I | I | I | I |
| | Thickness Ts (mm) | 1.00 | 1.00 | 1.00 | 1.00 |
| | Hardness HS (Shore D) | 67 | 67 | 67 | 67 |
| Mid layer | Composition | C | C | B | B |
| | Thickness Tm (mm) | 0.40 | 0.40 | 0.40 | 0.60 |
| | Hardness Hm (Shore D) | 38 | 38 | 47 | 47 |
| Cover | Composition | G | H | D | G |
| | Thickness Tc (mm) | 0.08 | 0.03 | 0.20 | 0.25 |
| | Hardness Hc (Shore D) | 16 | 5 | 32 | 16 |
| | Tc/Tm | 0.20 | 0.08 | 0.50 | 0.42 |
| | Tc/Hc | 0.005 | 0.006 | 0.006 | 0.016 |
| | Hm − Hc | 22 | 33 | 15 | 31 |
| W#1 | Spin (rpm) | 2350 | 2350 | 2300 | 2350 |
| | Flight distance (m) | 276.0 | 276.5 | 276.0 | 275.5 |
| SW *1 | Spin (rpm) | 7150 | 7100 | 7150 | 7100 |
| SW *2 | Spin (rpm) | 7050 | 7050 | 7000 | 7050 |
| | Spin (wet) (rpm) | 6150 | 6100 | 6050 | 6200 |

TABLE 4

| Evaluation Results | | | | | |
|---|---|---|---|---|---|
| | | Example 10 | Example 11 | Example 12 | Example 13 |
| Core | Diameter (mm) | 40.14 | 37.70 | 38.10 | 38.40 |
| | Amount of compressive deformation D1 (mm) | 3.4 | 3.0 | 3.0 | 3.0 |
| | Surface hardness H2 (JIS-C) | 83 | 81 | 81 | 81 |
| Surround-ing layer | Composition | I | I | I | J |
| | Thickness Ts (mm) | 1.00 | 1.00 | 1.00 | 1.00 |
| | Hardness HS (Shore D) | 67 | 67 | 67 | 57 |

TABLE 4-continued

| Evaluation Results | | | | | |
|---|---|---|---|---|---|
| | | Example 10 | Example 11 | Example 12 | Example 13 |
| Mid layer | Composition | D | J | A | A |
| | Thickness Tm (mm) | 0.20 | 1.20 | 1.00 | 1.00 |
| | Hardness Hm (Shore D) | 32 | 57 | 54 | 54 |
| Cover | Composition | H | E | E | D |
| | Thickness Tc (mm) | 0.08 | 0.30 | 0.30 | 0.15 |
| | Hardness Hc (Shore D) | 5 | 26 | 26 | 32 |
| | Tc/Tm | 0.40 | 0.25 | 0.30 | 0.15 |
| | Tc/Hc | 0.016 | 0.012 | 0.012 | 0.005 |
| | Hm − Hc | 27 | 31 | 28 | 22 |
| W#1 | Spin (rpm) | 2350 | 2300 | 2350 | 2250 |
| | Flight distance (m) | 276.5 | 275.0 | 274.5 | 275.5 |
| SW *1 | Spin (rpm) | 7150 | 7150 | 7200 | 7100 |
| SW *2 | Spin (rpm) | 7100 | 7050 | 7100 | 6900 |
| | Spin (wet) (rpm) | 6150 | 6100 | 6150 | 6000 |

TABLE 5

| Evaluation Results | | | | | | |
|---|---|---|---|---|---|---|
| | | Compa. Example 1 | Compa. Example 2 | Compa. Example 3 | Compa. Example 4 | Compa. Example 5 |
| Core | Diameter (mm) | 39.90 | 39.30 | 37.90 | 39.60 | 39.50 |
| | Amount of compressive deformation D1 (mm) | 3.3 | 3.2 | 3.0 | 3.2 | 3.2 |
| | Surface hardness H2 (JIS-C) | 82 | 82 | 81 | 82 | 82 |
| Sur-rounding layer | Composition | I | I | I | I | I |
| | Thickness Ts (mm) | 1.00 | 1.00 | 1.00 | 1.00 | 1.00 |
| | Hardness HS (Shore D) | 67 | 67 | 67 | 67 | 67 |
| Mid layer | Composition | — | B | B | E | A |
| | Thickness Tm (mm) | — | 0.50 | 1.30 | 0.35 | 0.20 |
| | Hardness Hm (Shore D) | — | 47 | 47 | 26 | 54 |
| Cover | Composition | E | C | D | C | G |
| | Thickness Tc (mm) | 0.40 | 0.20 | 0.10 | 0.20 | 0.40 |
| | Hardness Hc (Shore D) | 26 | 38 | 32 | 38 | 16 |
| | Tc/Tm | — | 0.40 | 0.08 | 0.57 | 2.00 |
| | Tc/Hc | 0.015 | 0.005 | 0.003 | 0.005 | 0.025 |
| | Hm − Hc | — | 9 | 15 | −12 | 38 |
| W#1 | Spin (rpm) | 2450 | 2300 | 2400 | 2550 | 2650 |
| | Flight distance (m) | 272.5 | 276.0 | 272.0 | 271.0 | 269.5 |
| SW *1 | Spin (rpm) | 7250 | 7000 | 7150 | 7100 | 7300 |
| SW *2 | Spin (rpm) | 7050 | 6700 | 6900 | 6800 | 7200 |
| | Spin (wet) (rpm) | 6150 | 5450 | 5950 | 5500 | 6500 |

As is shown in Tables 2 to 5, the golf ball of each Example is excellent in all the evaluation items. Therefore, advantages of the present invention are clearly suggested by these results of evaluation. The golf ball according to the present invention can be used for the play at the golf course, and the practice at the driving range. The foregoing description is just for illustrative examples; therefore, various modifications can be made in the scope without departing from the principles of the present invention.

What is claimed is:

1. A golf ball comprising a core, a surrounding layer situated on the external side of the core, a mid layer situated on the external side of the surrounding layer, and a cover situated on the external side of the mid layer, the mid layer having a thickness Tm of 0.1 mm or greater and 1.2 mm or less, the ratio (Tc/Tm) of the thickness Tc of the cover to the thickness Tm of the mid layer being no greater than 0.38, the cover having a Shore D hardness Hc of no greater than 35, the Shore D hardness Hm of the mid layer being greater than the Shore D hardness Hc of the cover, the base material of the mid layer is a polyurethane, the difference (Hs −Hm) between the hardness Hs and the hardness Hm is 5 or greater and 40 or less, the difference (Hm −Hc) between the hardness Hm and the hardness Hc is 3 or greater and 30 or less, the difference (Hs −Hc) between the hardness Hs and the hardness Hc is 25 or greater and 60 or less, and an amount of compressive deformation Dm of a spherical body composed of the core, the surrounding layer and the mid layer is 1.8 mm or greater and 3.8 mm or less.

2. The golf ball according to claim 1, wherein the mid layer has a Shore D hardness Hm of 30 or greater and 60 or less.

3. The golf ball according to claim 1, wherein the surrounding layer has a Shore D hardness Hs of no less than 50.

4. The golf ball according to claim 1, wherein the surrounding layer has a thickness Ts of 0.5 mm or greater and 2.4 mm or less.

5. The golf ball according to claim 1, wherein the base material of the surrounding layer is an ionomer resin.

6. The golf ball according to claim 1, wherein the base material of the cover is one or at least two selected from the group consisting of a polyurethane based elastomer, a polyester based elastomer, a polyamide based elastomer, a polyolefin based elastomer, a polystyrene based elastomer and an ionomer resin.

7. The golf ball according to claim 6, wherein the base material of the cover is a polyurethane.

8. The golf ball according to claim 1, wherein the cover has a thickness Tc of no greater than 0.60 mm.

9. The golf ball according to claim 1, wherein the ratio (Tc/Hc) of the thickness Tc (mm) of the cover to the hardness Hc of the cover is no greater than 0.018.

10. The golf ball according to claim 1, wherein the central point of the core has a JIS-C hardness H1 of 35 or greater and 80 or less.

11. The golf ball according to claim 1, wherein the surface of the core has a JIS-C hardness H2 of 45 or greater and 100 or less.

12. The golf ball according to claim 1, wherein the difference (H2−H1) between the JIS-C hardness H2 of the surface and the JIS-C hardness H1 of the central point of the core is 5 or greater and 35 or less.

13. The golf ball according to claim 1 further having a paint layer situated on the external side of the cover.

14. The golf ball according to claim 1, wherein an amount of compressive deformation Ds of a spherical body composed of the core and the surrounding layer is 2.0 mm or greater and 3.8 mm or less.

* * * * *